US007465701B2

(12) United States Patent
Sharma et al.

(10) Patent No.: US 7,465,701 B2
(45) Date of Patent: Dec. 16, 2008

(54) DETERGENT COMPOSITION

(75) Inventors: Sanjeev Sharma, Newcastle-upon-Tyne (GB); Carlos Arca Quinones, Newcastle-upon-Tyne (GB); Mayumi Daiki, Newcastle-upon-Tyne (GB); Arturo Luis Casado Dominguez, Mannheim (DE); Dieter Boeckh, Limburgerhof (DE); Lidcay Herrera Taboada, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 121 days.

(21) Appl. No.: 11/443,706

(22) Filed: May 31, 2006

(65) Prior Publication Data

US 2007/0281879 A1 Dec. 6, 2007

(51) Int. Cl.
*C11D 3/37* (2006.01)
*C11D 11/02* (2006.01)
*C11D 17/06* (2006.01)

(52) U.S. Cl. ..... 510/475; 510/438; 510/443; 510/452; 510/456

(58) Field of Classification Search ..... 510/438, 510/443, 452, 456, 475
See application file for complete search history.

(56) References Cited

U.S. PATENT DOCUMENTS 4,746,456 A 5/1988 Kud et al.
4,999,869 A * 3/1991 Holland et al. ..... 8/115.62
5,635,554 A * 6/1997 Boeckh et al. ..... 524/377
5,820,637 A 10/1998 Bory et al.
5,981,460 A 11/1999 Dodd et al.
6,127,329 A 10/2000 Baillely et al.
6,498,136 B2 * 12/2002 Rodrigues ..... 510/476
6,835,707 B1 12/2004 Panandiker et al.
2003/0162679 A1 * 8/2003 Rodrigues et al. ..... 510/296

FOREIGN PATENT DOCUMENTS

EP 0 358 474 A2 3/1990
WO WO 91/09932 A1 7/1991

OTHER PUBLICATIONS

PCT International Search Report—3 Pages, Sep. 5, 2006.

* cited by examiner

*Primary Examiner*—Brian P Mruk
(74) *Attorney, Agent, or Firm*—Ronald T. Sia; David V. Upite; Laura R. Grunzinger

(57) ABSTRACT

A detergent auxiliary composition comprising from 0.001 wt % to 99 wt % cleaning polymer having a hydrophilic backbone and at least one hydrophobic pendant group, and an adjunct ingredient in which the hydrophilic backbone constitutes less than 50%, preferably less than 45% by weight of the polymer. The detergent auxiliary composition may be, for example a spray-dried particle or an agglomerate. Also described are detergent compositions comprising the detergent auxiliary composition.

21 Claims, No Drawings

DETERGENT COMPOSITION

TECHNICAL FIELD

The present invention relates to detergent auxiliary compositions in particulate form comprising a greasy stain cleaning polymer, processes for making such detergent auxiliary compositions, laundry detergent compositions comprising such detergent auxiliary compositions and use of said cleaning polymer to enhance greasy stain removal performance of a detergent composition, particularly a laundry detergent composition.

BACKGROUND OF THE INVENTION

The satisfactory removal of greasy soils/stains, particularly soils/stains having a high proportion of triglycerides or fatty acids, is a challenge faced by the formulator of detergent compositions for use in cleaning applications such as laundry or dish-washing, particularly laundry cleaning applications. One means of formulating for oily stain removal relates to selection of specific surfactants and surfactant types, for example use of cationic surfactants as described in WO97/43367. However, present formulating routes including cationic surfactants still require complex surfactant systems comprising at least two or even three or more separate surfactants to be used.

There is still therefore a need to provide alternatives to cationic surfactants to provide cleaning of oily stains, in particular, alternatives which enable less complex formulation routes to be used to effect oily stain removal.

Polymeric ingredients are known for incorporation into cleaning compositions. For example, in WO91/09932, polymers described as deflocculating polymers are incorporated into detergent composition particles to provide improved dispersing granular detergent compositions. Graft copolymers are known for incorporation into detergent compositions, for example as described in EP-A-219 048 and EP-A-358474.

SUMMARY OF THE INVENTION

The present inventors have found that a particular class of polymers is effective at producing oily stain removal. Furthermore, such polymers produce an unexpected improvement in processing of detergent compositions containing them, by reducing the viscosity of liquid components that are mixed together during the manufacture of the detergent composition. This viscosity reducing effect allows the detergent composition to be manufactured more efficiently and cost effectively.

In accordance with a first aspect of the present invention, there is provided a detergent auxiliary composition comprising from 0.001 wt % to 99 wt % polymer having a hydrophilic backbone and at least one hydrophobic pendant group, in which the hydrophilic backbone constitutes less than 50% by weight of the polymer, and an adjunct component. The composition may comprise less than 10 wt % zeolite (anhydrous basis) and less than 55 wt % or even less than 50 wt % sodium carbonate and/or sesquicarbonate.

A preferred adjunct comprises a builder or mixture of builders, as described below. Preferably, where builder is present it will be present in the auxiliary composition in an amount of from 1 to 80 wt % of the auxiliary composition, more preferably from 1 to 50 wt %. Preferably zeolite will be present in amounts below 10 wt %. Phosphate builders are preferred adjuncts, and more preferably sodium tripolyphosphate. It may be preferred to include phosphate builders in amounts above 10 wt %, based on the weight of the detergent auxiliary composition, for example from 11 to 50 wt %, or even from 15 to 40 wt %. It may be preferred to keep the level of sodium carbonate and/or sesqui-carbonate to below 55 wt % or even below 50 wt %. Other preferred adjunct components include caboxymethyl cellulose, for example in amounts from 0.1 to 10 wt %; polycarboxylate polymers such as maleic acid, acrylic acid copolymers and/or their salts e.g. Sokalan CP5 (from BASF).

In accordance with a second aspect of the invention there is provided a process for making said detergent auxiliary composition the process comprising a first step in which an aqueous detergent slurry is prepared comprising mixing grease-cleaning polymer, detergent adjunct and water, and a second step in which the slurry is spray-dried.

In accordance with a further aspect of the invention there is provided a detergent slurry comprising from 0.001 to 90 wt % (based on the weight of the slurry) of the greasy stain cleaning polymer for preparing the detergent auxiliary composition.

In a further aspect of the invention there is provided a process for making a detergent auxiliary composition comprising mixing and granulating grease-cleaning polymer and detergent adjunct component in a high speed mixer/granulator, or fluidised bed agglomerator.

In accordance with a further aspect of the invention, the detergent auxiliary composition of the invention is prepared by spraying a solution of the polymer in a solvent onto detergent adjunct material.

In accordance with a further aspect of the invention there is provided a fully formulated detergent composition comprising from 0.01 wt % to 90 wt % of the detergent auxiliary composition and an adjunct detergent component.

According to a further aspect of the invention there is provided use of a polymer having a hydrophilic backbone and at least one hydrophobic pendant group, in which the hydrophilic backbone constitutes less than 50% by weight of the polymer in the manufacture of a detergent composition for greasy stain removal.

DETAILED DESCRIPTION OF THE INVENTION

Detergent Auxiliary Composition a) Cleaning Polymer

The grease-cleaning polymers for use in the present invention are random graft copolymers. They comprise a hydrophilic backbone and hydrophobic side chains, where the hydrophilic backbone constitutes less than 50%, preferably less than 45% by weight of the polymer, or even less than 40% by weight of the polymer, generally at least 2% or at least 5% or at least 10% by weight.

The backbone of the polymer preferably comprises monomers selected from the group consisting of unsaturated C1-6 acids, ethers, alcohols, aldehydes, ketones or esters, sugar units, alkoxy units, maleic anhydride and saturated polyalcohols such as glycerol, and mixtures thereof. The hydrophilic backbone may comprise acrylic acid, methacrylic acid, maleic acid, vinyl acetic acid, glucosides, alkylene oxide, glycerol, or mixtures thereof. Preferably, the polymer comprises a polyalkylene oxide backbone comprising ethylene oxide, propylene oxide and/or butylene oxide. The polyalkylene oxide backbone may comprise more than 80% by weight of ethylene oxide, or even more than 90% or more than 95% weight of the weight of the polyalkylene oxide backbone. The weight average molecular weight (MW) of the polyalkylene oxide backbone is generally from 350 or 400 to 40000 g/mol or from about 350 to 20,000 g/mol or from about 1000 to 18000 g/mol or even 3000 or 4000 to 9000 or 13500 g/mol. The polyalkylene oxide backbone may be linear or branched in structure. The polyalkylene backbone may be extended by condensation with suitable connecting molecules such as, but not limited to, dicarboxylic acids and/or diisocianates.

The backbone comprises a plurality of hydrophobic side chains. Preferred hydrophobic side chains comprise C4-25 alkyl groups, polypropylene and polybutylene units, vinyl esters of saturated monocarboxylic acid containing from 1 to 6 carbon atoms, C1-6 alkyl ester of acrylic or methacrylic acid; or mixtures thereof. The hydrophobic side chains may comprise vinyl acetate in an amount more than 50% by weight of the weight of said hydrophobic side chains, more preferably more than 70% and most preferably more than 90% weight of the weight of said hydrophobic side chains; and/or the hydrophobic side chains comprise butyl acrylate from about 0.1% to 10% by weight of said hydrophobic side chains, more preferably from about 1% to 7% by weight, and most preferably from about 2% to 5% by weight of said hydrophobic side chains. The hydrophobic side chains may also comprise modifying monomer such as, but not limited to, styrene, N-vinylpyrrolidone, acrylic acid, methacrylic acid, maleic acid, acrylamide, vinyl acetic acid and/or vinyl formamide. More preferred, the hydrophobic side chains may also comprise styrene from about 0.1% to 5% by weight of said hydrophobic side chains, more preferably from about 0.5% to 4% by weight, and most preferably from about 1% to 3% by weight of said hydrophobic side chains and/or the hydrophobic side chains comprise N-vinylpyrrolidone from about 0.1% to 10% weight of said hydrophobic side chains, more preferably from about 0.5% to 6% by weight, and most preferably from about 1% to 3% by weight of said hydrophobic side chains.

The polymer may comprise a random graft polymer which is obtained by grafting (a) polyethylene oxide; (b) a vinyl ester derived from acetic acid and/or propionic acid; an alkyl ester of acrylic or methacylic acid in which the alkyl group contains from 1 to 4 carbon atoms, and mixtures thereof; and (c) modifying monomers such as N-vinylpyrrolidone and/or styrene. The polymer for use in the present invention may have the general formula:

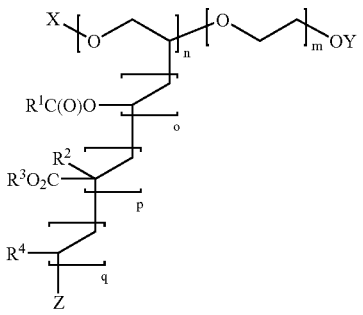

where X and Y are capping units independently selected from H or C1-C6 alkyl; Z is a capping unit independently selected from H or C-radical moiety (i.e. a carbon-containing fragment derived from the radical initiator attached to the growing chain as a result of a recombination process); each $R^1$ is independently selected from methyl and/or ethyl; each $R^2$ is independently selected from H and/or methyl; each $R^3$ is independently selected from C1-C4 alkyl; and each $R^4$ is independently selected from pyrrolidone and/or phenyl groups. The value of m, n, o, p and q is selected such that the molecular weight of the polyethylene oxide backbone is from about 1000 to 12000 g/mol, as described above or from about 3000 to 9000 g/mol or from 4000 to 6000 g/mol. The pendant groups typically comprise at least 50 weight %, or even at least 55 weight % or at least 60 weight % of the polymer and generally up to 98 weight % or 95 or 90 weight % of the polymer. The polymer useful herein typically has a MW from 1000 g/mol or from 2500 or from 7500 or 1000 g/mol to 150000 or 100000 or 45000 or 34000 g/mol. Preferably the polymer is manufactured by a radical grafting polymerization reaction carried out with a suitable radical initiator at temperatures below 100° C., more preferably below 85° C. and most preferred below 75° C. Typically the temperature will be from 60° C. or 65° C. or from about 70° C. While polymers have previously been disclosed which have grafting temperatures above 100° C., the lower temperatures and kinetics herein result in a significantly different polymer primary structure. While these are still "random graft polymers" the lower grafting temperature increases the overall/average size of each individual grafted chain and the grafted chains are more spaced out across the polymer. So polymers formed at the lower grafting temperatures are overall more hydrophilic and have comparatively higher cloud points in water than polymers formed at the higher grafting temperatures, even if the same reactants and raw materials are used, and the final MW and backbone: grafted chain weight ratio is the same. The polymer may have from about 0.5 to about 1.5, or from about 0.6 to about 1.25, or from 0.75 to 1.1 graft points per backbone monomer unit, ethylene oxide unit, polyethylene glycol unit, or etc, as is appropriate for that individual polymer. The number of graft points per backbone monomer unit (or other unit as appropriate for that polymer) is determined by NMR spectroscopy analysis of the neat polymer, as solvents may interfere with the NMR measurement.

The polymer may further contain a plurality of hydrolysable moieties, such as ester- or amide-containing moieties which may be partially or fully hydrolysed. The degree of hydrolysis of the polymer is defined as the mol % of hydrolysable moieties which have been hydrolysed into the corresponding fragments. Typically the degree of hydrolysis of the polymer will be no greater than 75 mol % or from about 0 mol % to about 75 mol % or from 0 mol % to about 60 mol % or from about 0 mol % to 40 mol %. In other embodiments the degree of hydrolysis is from 30 to 40 mol % or 0 to 10 mol %.

The polymers may be partially or fully hydrolyzed. The degree of hydrolysis of the polymer is defined as the mol % of ester linkages which have been saponified into corresponding alcohol and carboxylate derivatives. Preferably the degree of hydrolysis of the polymer will be no greater than 75 mol %, more preferably no greater than 60% and most preferably no greater than 40%.

The polymer is present in the detergent auxiliary composition in an amount of from 0.001 to 90 wt %, typically 0.01 to 25 wt % or 0.01 to 15 wt %.

b) Adjunct Ingredients

The detergent adjunct material comprises any of the adjunct ingredients listed below. Typically the auxiliary composition of the invention will comprise surfactant, and generally this will comprise an anionic surfactant. Although high levels of surfactant may be incorporated for example from 10 to 60 wt %, may be preferred that the level of anionic surfactant in the auxiliary composition, especially where the anionic surfactant comprises alkyl benzene sulphonate, is below 9 wt % based on the total weight of the auxiliary composition. The level of surfactant may be from 0.5 wt % to 8.5 wt %, or 1 wt % to 7 wt % based on the total weight of the auxiliary composition.

Preparation of the Detergent Auxiliary Composition

The detergent auxiliary composition may be obtainable, and/or may be obtained, by an agglomeration, spray-drying, freeze drying or extrusion process. In one embodiment of the invention, the detergent auxiliary composition comprises a spray dried particle. Spray drying processes for making detergent composition particles are prepared by first forming a fluid composition conventionally referred to as slurry and the slurry is subjected to a drying step, generally by spray drying, to produce particulate detergent component.

The grease cleaning polymers of the invention have been found to be particularly advantageous in such a process because they have been found unexpectedly to reduce the viscosity of the slurry. Generally in preparing slurries for spray-drying, it is advantageous to produce the most concentrated slurry possible, containing the lowest water levels possible, so that the drying process is most efficient and cost effective and less water needs to be removed from the slurry. However, the process is limited by the viscosities produced by an aqueous solution of the surfactant and other components in the slurry, as the slurry still has to be of a sufficiently low viscosity that it can be sprayed into the spray-drying tower. Use of the grease cleaning polymers defined above has been found to surprisingly lower the viscosity of the slurry enabling lower levels of water, such as below 30 wt % or even below 28 wt % or even below 25 wt % in the slurry to result in a sprayable slurry. Preferably the weight ratio of the polymer to the total surfactant in the slurry is from 100:1 to 10:1, more preferably from 50:1 to 20:1.

Spray-drying is achieved by conventional means (usually using warm air drying although spray cooling may also be useful). Generally this will be in a spray-drying tower using a high pressure (e.g. 6000-7000 kPa) spray nozzle. Spinning disc atomisers may also be used. Generally raw materials which are provided by suppliers in solution or dispersion in water are pre-mixed and the solids subsequently added to form the slurry.

In an alternative embodiment, the detergent auxiliary composition of the invention are prepared by an agglomeration process in which the polymer and detergent adjunct component are mixed and granulated in a high speed mixer/granulator or fluidised bed agglomerator. Suitable processes are described in U.S. Pat. No. 5,133,924 and WO97/22685. The present inventors have found that the presence of the polymer, particularly when mixed with the other liquid components for forming the agglomerate, such as surfactant, produces an unexpected benefit in that since it promotes mixing between the solid and liquid components, much more even particle size agglomerates are generated and oversize particle production is significantly reduced.

In a further embodiment of the invention the detergent auxiliary compositions are prepared by spraying a solution of the polymer in a solvent onto solid detergent adjunct material. The solid detergent adjunct material may be raw materials, or pre-processed particles such as spray-dried particles or agglomerates or extrudates or combinations thereof. The solvent may be water, but advantageously comprises more viscous detergent adjunct component, such as surfactant. The present invention is highly advantageous for enabling spray on of more viscous detergent adjunct components because the polymer lowers the viscosity of such component, allowing spray on and/or promoting better mixing with the solid detergent adjunct material because production of a finer spray-on is enabled compared to spraying the same liquid detergent adjunct component in the absence of the polymer.

Preferred detergent adjunct components for spraying on in this way comprise surfactant which may be anionic, cationic, non-ionic, amphiphilic, or amphoteric or mixtures thereof, as described below. The invention is particularly useful for enabling/facilitating spray on of non-ionic and/or anionic surfactant by first forming a pre-mix. Generally such a pre-mix for spraying onto solid detergent material will comprise polymer to surfactant in a weight ratio of from 1:100 to 2:1, more typically from 1:50 to 1:10. Generally, the weight ratio of solid detergent material to spray on will be from 100:1 to 10:1, more usually from 50:1 to 15:1.

The particles produced will generally have a bulk density at least 300 g/l or at least 400 g/l and up to 1000 g/l or 900 g/l or below (as measured by the method now described). The final density of the particles and compositions herein can be measured by a simple technique which involves dispensing a quantity of the granular material into a container of known volume, measuring the weight of material and reporting the density as grams/liter. The method used herein allows the material to flow into the measuring container under gravity, and without pressure or other compaction in the measuring container. The density measurements should be run at room temperature. The granular material whose density is being measured should be at least 24 hours old and should be held at room temperature for 24 hours prior to testing. A relative humidity of 50% or less is convenient. Of course, any clumps in the material should be gently broken up prior to running the test. The sample of material is allowed to flow through a funnel mounted on a filling hopper and stand (#150; Seedburo Equipment Company, Chicago, Ill.) into an Ohaus cup of known volume and weight (#104; Seedburo). The top of the cup is positioned about 50 mm from the bottom of the funnel, and the cup is filled to overflowing. A spatula or other straight edge is then scraped over the top of the cup, without vibration or tapping, to level the material, thereby exactly and entirely filling the cup. The weight of material in the cup is then measured. Density can be reported as g/l. Two repeat runs are made and the bulk density is reported as an average of the three measurements. Relative error is about 0.4%.

In a further embodiment of the invention the detergent auxiliary particles are further processed to incorporate them into conventional granules such as agglomerates or extrudates and/or dry mixing with other particulate and/or spray-on liquid components. Where the detergent auxiliary composition is further processed by agglomeration or extrusion, any solid particulate in a conventional granulation process is wholly or partially replaced by the detergent auxiliary composition particles of the present invention. Suitable conventional and known granulation processes include using a pan-granulator, fluidized bed, Schugi mixer, Lödige ploughshare mixer, rotating drum or other low energy mixers, marumeriser or spheroniser; by compaction, including extrusion optionally with spheronising or marumerising, and tabletting; when melt binding agents are used by prilling and pastilling using a Sandvik Roto Former; and by high shear processes in which the mixers have a high speed stirring and cutting action. Suitable mixers will be well known to those skilled in the art.

Suitable processes are described in the patent literature: an example of an agglomeration process is described in U.S. Pat. No. 5,133,924 (Appel). An example of a suitable fluidised bed agglomeration process is described for example in WO97/22685 (Dhanuka). Suitable extrusion processes are described for example in WO97/03181 (EP-A-840780) (Henkel) or in EP-A-518888 (Henkel). The detergent auxiliary composition is suitable for incorporation into a detergent composition, such as a laundry detergent composition; i.e. to make a fully formulated detergent composition. Alternatively, the detergent auxiliary composition is suitable for use in combination with a detergent composition such as a laundry detergent composition i.e. as an additive to an already fully formulated detergent composition.

The composition typically has a mean particle size of from 250 micrometers to 2000 micrometers, preferably from 350 to 1500 micrometers, and/or typically no more than 10 wt % of the composition has a particle size less than 50 micrometers and/or typically no more than 10 wt % of the composition has a particle size greater than 1200 micrometers.

Detergent Compositions Incorporating the Detergent Auxiliary Composition Particles In accordance with a further embodiment of the invention, there is provided a detergent composition comprising a detergent auxiliary composition particle as described above. Suitable detergent compositions may be for any cleaning purpose, but the invention is particularly directed to laundry washing applications. The detergent composition will generally be in the form of a solid composition. Solid compositions include powders, granules, noodles, flakes, bars, tablets, and combinations thereof. The detergent composition may be in the form of a liquid composition. The detergent composition may also be in the form of a paste, gel, liqui-gel, suspension, or any combination thereof. The detergent composition may be at least partially enclosed, preferably completely enclosed, by a film or laminate such as a water-soluble and/or water-dispersible material. Preferred water-soluble and/or water-dispersible materials are polyvinyl alcohols and/or carboxymethyl celluloses.

The detergent compositions of the invention are preferably granular detergents having an overall bulk density of from 350 to 1000 g/l, more preferably 550 to 1000 g/l or even 600 to 900 g/l. Generally the particles of the invention will be mixed with other detergent particles including combinations of agglomerates, spray-dried powders and/or dry added materials such as bleaching agents, enzymes etc, to provide a level of polymer in the finished product from 0.01 or from 0.1 wt % based on finished product up to 10 wt %, or up to 7 wt % or even up to 5 wt %. Generally this means that the particles of the invention may be added into a detergent composition in amounts generally from 40 to 99 wt % based on finished product, or from 50 to 95 wt % or from 55 to 90 wt % based on finished product.

Preferably, the detergent particles or the composition has a size average particle size of from 200 μm to 2000 μm, preferably from 350 μm to 600 μm. As described above, detergent compositions comprising the particles made by the process of the invention will comprise at least some of the usual detergent adjunct materials, such as agglomerates, extrudates, other spray dried particles having different composition to those of the invention, or dry added materials. Conventionally, surfactants are incorporated into agglomerates, extrudates or spray dried particles along with solid materials, usually builders, and these may be admixed with the spray dried particles of the invention. However, as described above some or all of the solid material may be replaced with the particles made according to the invention.

Detergent Adjunct Materials

The detergent adjunct materials are typically selected from the group of components consisting of detersive surfactants, builders, polymeric co-builders, bleach, chelants, enzymes, anti-redeposition polymers, soil-release polymers, polymeric soil-dispersing and/or soil-suspending agents, dye-transfer inhibitors, fabric-integrity agents, suds suppressors, fabric-softeners, flocculants, perfumes, whitening agents, hueing agents such as photobleach, dyes etc, and combinations thereof. The precise nature of these additional components, and levels of incorporation thereof will depend on the physical form of the composition or component, and the precise nature of the washing operation for which it is to be used.

A highly preferred adjunct component is a surfactant. Preferably, the detergent composition comprises one or more surfactants. Typically, the detergent composition comprises (by weight of the composition) from 0% to 50%, preferably from 5% and more preferably from 10 or even 15 wt % to 40%, or to 30%, or to 20% one or more surfactants. Preferred surfactants are anionic surfactants, non-ionic surfactants, cationic surfactants, zwitterionic surfactants, amphoteric surfactants, cationic surfactants and mixtures thereof.

Preferred anionic surfactants comprise one or more moieties selected from the group consisting of carbonate, phosphate, sulphate, sulphonate and mixtures thereof. Preferred anionic surfactants are $C_{8-18}$ alkyl sulphates and $C_{8-18}$ alkyl sulphonates. Suitable anionic surfactants incorporated alone or in mixtures in the compositions of the invention are also the $C_{8-18}$ alkyl sulphates and/or $C_{8-18}$ alkyl sulphonates optionally condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. Other preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups. Mid chain branched alkyl sulfates or alkyl alkoxy sulfates (see U.S. Pat. Nos. 6,020,303, 6,060,443, 6,008,181) and/or methyl ester sulfonate (especially for cold water laundering) and/or alpha-olefin sulphonate (AOS) may be useful.

Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. The anionic surfactants may be present in the salt form. For example, the anionic surfactant may be an alkali metal salt of one or more of the compounds selected from the group consisting of: $C_{8-18}$ alkyl sulphate, $C_{8-18}$ alkyl sulphonate, $C_{8-18}$ alkyl benzene sulphate, $C_{8-18}$ alkyl benzene sulphonate, and combinations thereof. Preferred alkali metals are sodium, potassium and mixtures thereof. Typically, the detergent composition comprises from 10% to 30 wt % anionic surfactant.

Preferred non-ionic surfactants are selected from the group consisting of: $C_{8-18}$ alcohols condensed with from 1 to 9 of $C_1$-$C_4$ alkylene oxide per mole of $C_{8-18}$ alcohol, $C_{8-18}$ alkyl N—$C_{1-4}$ alkyl glucamides, $C_{8-18}$ amido $C_{1-4}$ dimethyl amines, $C_{8-18}$ alkyl polyglycosides, glycerol monoethers, polyhydroxyamides, and combinations thereof. Typically the detergent compositions of the invention comprises from 0 to 15, preferably from 2 to 10 wt % non-ionic surfactant.

Preferred cationic surfactants are quaternary ammonium compounds. Preferred quaternary ammonium compounds comprise a mixture of long and short hydrocarbon chains, typically alkyl and/or hydroxyalkyl and/or alkoxylated alkyl chains. Typically, long hydrocarbon chains are $C_{8-18}$ alkyl chains and/or $C_{8-18}$ hydroxyalkyl chains and/or $C_{8-18}$ alkoxylated alkyl chains. Typically, short hydrocarbon chains are $C_{1-4}$ alky chains and/or $C_{1-4}$ hydroxyalkyl chains and/or $C_{1-4}$ alkoxylated alkyl chains. Typically, the detergent composition comprises (by weight of the composition) from 0% to 20% cationic surfactant.

Preferred zwitterionic surfactants comprise one or more quaternized nitrogen atoms and one or more moieties selected from the group consisting of: carbonate, phosphate, sulphate, sulphonate, and combinations thereof. Preferred zwitterionic surfactants are alkyl betaines. Other preferred zwitterionic surfactants are alkyl amine oxides. Catanionic surfactants which are complexes comprising a cationic surfactant and an anionic surfactant may also be included. Typically, the molar ratio of the cationic surfactant to anionic surfactant in the complex is greater than 1:1, so that the complex has a net positive charge.

A further preferred adjunct component is a builder. Preferably, the detergent composition comprises (by weight of the composition and on an anhydrous basis) from 5% to 50% builder. Preferred builders are selected from the group consisting of: inorganic phosphates and salts thereof, preferably orthophosphate, pyrophosphate, tri-poly-phosphate, alkali metal salts thereof, and combinations thereof; polycarboxylic acids and salts thereof, preferably citric acid, alkali metal salts of thereof, and combinations thereof; aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof; silicates such as layered silicates, salts thereof, and combinations thereof, preferably sodium layered silicate; and combinations thereof.

A preferred adjunct component is a bleaching agent. Preferably, the detergent composition comprises one or more bleaching agents. Typically, the composition comprises (by weight of the composition) from 1% to 50% of one or more bleaching agent. Preferred bleaching agents are selected from the group consisting of sources of peroxide, sources of peracid, bleach boosters, bleach catalysts, photo-bleaches, and combinations thereof. Preferred sources of peroxide are selected from the group consisting of: perborate monohydrate, perborate tetra-hydrate, percarbonate, salts thereof, and combinations thereof. Preferred sources of peracid are selected from the group consisting of: bleach activator typically with a peroxide source such as perborate or percarbonate, preformed peracids, and combinations thereof. Preferred bleach activators are selected from the group consisting of: oxy-benzene-sulphonate bleach activators, lactam bleach activators, imide bleach activators, and combinations thereof. A preferred source of peracid is tetra-acetyl ethylene diamine (TAED)and peroxide source such as percarbonate. Preferred oxy-benzene-sulphonate bleach activators are selected from the group consisting of: nonanoyl-oxy-benzene-sulponate, 6-nonamido-caproyl-oxy-benzene-sulphonate, salts thereof, and combinations thereof. Preferred lactam bleach activators are acyl-caprolactams and/or acyl-valerolactams. A preferred imide bleach activator is N-nonanoyl-N-methyl-acetamide.

Preferred preformed peracids are selected from the group consisting of N,N-pthaloyl-amino-peroxycaproic acid, nonyl-amido-peroxyadipic acid, salts thereof, and combinations thereof. Preferably, the STW-composition comprises one or more sources of peroxide and one or more sources of peracid. Preferred bleach catalysts comprise one or more transition metal ions. Other preferred bleaching agents are di-acyl peroxides. Preferred bleach boosters are selected from the group consisting of: zwitterionic imines, anionic imine polyions, quaternary oxaziridinium salts, and combinations thereof. Highly preferred bleach boosters are selected from the group consisting of: aryliminium zwitterions, aryliminium polyions, and combinations thereof. Suitable bleach boosters are described in U.S. Pat. Nos. 5,360,568, 5,360,569 and 5,370,826.

A preferred adjunct component is an anti-redeposition agent. Preferably, the detergent composition comprises one or more anti-redeposition agents. Preferred anti-redeposition agents are cellulosic polymeric components, most preferably carboxymethyl celluloses.

A preferred adjunct component is a chelant. Preferably, the detergent composition comprises one or more chelants. Preferably, the detergent composition comprises (by weight of the composition) from 0.01% to 10% chelant. Preferred chelants are selected from the group consisting of: hydroxyethane-dimethylene-phosphonic acid, ethylene diamine tetra(methylene phosphonic) acid, diethylene triamine pentacetate, ethylene diamine tetraacetate, diethylene triamine penta(methyl phosphonic) acid, ethylene diamine disuccinic acid, and combinations thereof.

A preferred adjunct component is a dye transfer inhibitor. Preferably, the detergent composition comprises one or more dye transfer inhibitors. Typically, dye transfer inhibitors are polymeric components that trap dye molecules and retain the dye molecules by suspending them in the wash liquor. Preferred dye transfer inhibitors are selected from the group consisting of: polyvinylpyrrolidones, polyvinylpyridine N-oxides, polyvinylpyrrolidone-polyvinylimidazole copolymers, and combinations thereof.

A preferred adjunct component is an enzyme. Preferably, the detergent composition comprises one or more enzymes. Preferred enzymes are selected from then group consisting of: amylases, arabinosidases, carbohydrases, cellulases, chondroitinases, cutinases, dextranases, esterases, β-glucanases, gluco-amylases, hyaluronidases, keratanases, laccases, ligninases, lipases, lipoxygenases, malanases, mannanases, oxidases, pectinases, pentosanases, peroxidases, phenoloxidases, phospholipases, proteases, pullulanases, reductases, tannases, transferases, xylanases, xyloglucanases, and combinations thereof. Preferred enzymes are selected from the group consisting of: amylases, carbohydrases, cellulases, lipases, proteases, and combinations thereof.

A preferred adjunct component is a fabric integrity agent. Preferably, the detergent composition comprises one or more fabric integrity agents. Typically, fabric integrity agents are polymeric components that deposit on the fabric surface and prevent fabric damage during the laundering process. Preferred fabric integrity agents are hydrophobically modified celluloses. These hydrophobically modified celluloses reduce fabric abrasion, enhance fibre-fibre interactions and reduce dye loss from the fabric. A preferred hydrophobically modified cellulose is described in WO99/14245. Other preferred fabric integrity agents are polymeric components and/or oligomeric components that are obtainable, preferably obtained, by a process comprising the step of condensing imidazole and epichlorhydrin.

A preferred adjunct component is a salt. Preferably, the detergent composition comprises one or more salts. The salts can act as alkalinity agents, buffers, builders, co-builders, encrustation inhibitors, fillers, pH regulators, stability agents, and combinations thereof. Typically, the detergent composition comprises (by weight of the composition) from 5% to 60% salt. Preferred salts are alkali metal salts of aluminate, carbonate, chloride, bicarbonate, nitrate, phosphate, silicate, sulphate, and combinations thereof. Other preferred salts are alkaline earth metal salts of aluminate, carbonate, chloride, bicarbonate, nitrate, phosphate, silicate, sulphate, and combinations thereof. Especially preferred salts are sodium sulphate, sodium carbonate, sodium bicarbonate, sodium silicate, sodium sulphate, and combinations thereof. Optionally, the alkali metal salts and/or alkaline earth metal salts may be anhydrous.

A preferred adjunct component is a soil release agent. Preferably, the detergent composition comprises one or more soil release agents. Typically, soil release agents are polymeric compounds that modify the fabric surface and prevent the redeposition of soil on the fabric. Preferred soil release agents are copolymers, preferably block copolymers, comprising one or more terephthalate unit. Preferred soil release agents are copolymers that are synthesised from dimethylterephthalate, 1,2-propyl glycol and methyl capped polyethyleneglycol. Other preferred soil release agents are anionically end capped polyesters.

A preferred adjunct component is a soil suspension agent. Preferably, the detergent composition comprises one or more soil suspension agents. Preferred soil suspension agents are polymeric polycarboxylates. Especially preferred are polymers derived from acrylic acid, polymers derived from maleic acid, and co-polymers derived from maleic acid and acrylic acid. In addition to their soil suspension properties, polymeric polycarboxylates are also useful co-builders for laundry detergents. Other preferred soil suspension agents are alkoxylated polyalkylene imines. Especially preferred alkoxylated polyalkylene imines are ethoxylated polyethylene imines, or ethoxylated-propoxylated polyethylene imine. Other preferred soil suspension agents are represented by the formula: bis($(C_2H_5O)(C_2H_4O)_n$)($CH_3$)—$N^+$—$C_xH_{2x}$—$N^+$—($CH_3$)-bis($(C_2H_4O)_n(C_2H_5O)$), wherein, n=from 10 to 50 and x=from 1 to 20. Optionally, the soil suspension agents represented by the above formula can be sulphated and/or sulphonated.

A preferred adjunct is a hueing agent or shading dye. These are formulated to improve the whiteness of laundry by imparting a subtle hue on the surface of the fabrics during the wash process which can help to mask the colour of residual or redeposited yellow soils. Unlike fluorescent brighteners which work by absorbing UV light and re-emitting visible light, shading dyes are not typically fluorescent and shade fabrics by absorbing light in the visible region of the electromagnetic spectrum.

Examples of suitable shading dyes are given in U.S. Pat. No. 3,775,201 (Colgate), U.S. Pat. No. 3,7628,59 (Colgate), WO 2005/003274 (Lever), WO 2005/003275 (Lever), WO 2005/003276 (Lever), WO 2005/003277 (Lever) and WO 2005/014769 (Ciba). Preferred materials are C.I Acid Violet numbers 9, 17, 24 and 49; C.I Acid Red numbers 4, 14, 17, 18, 27, 88, 103, 150, 151 and 266; C.I Acid Black numbers 1 and 24; CI Acid Blue numbers 15, 29, 45, 80, 83, 90 and 113; C.I Acid Orange numbers 7 and 8; C.I Direct Yellow 8; C.I Direct Red numbers 2, 23 and 81; C.I Direct Violet numbers 5, 7, 9, 11, 13, 51 and 66; CI Direct Blue numbers 1, 34, 70, 71 and 72.

Certain coloured photocatalysts serve a dual purpose of acting as both shading dyes and solar bleaching catalysts. Preferred materials are sulfonated zinc phthalocyanines, sulfonated aluminium phthalocyanines sulfonated aluminium phthalocyanines or mixtures of these. Tinolux® BBS and Tinolux® BMC are suitable photocatalyst products sold by Ciba speciality chemicals. The main ingredient in Tinolux® BBS is sulfonated aluminium phthalocyanine. Tinolux® BMC contains a mixture of sulfonated zinc and aluminium phthalocyanines. The presence of such photocatalysts in the detergent compositions can help to mitigate the buildup of other shading dyes on fabric through a photofading mechanism as described in WO 2005/014769 (Ciba).

Softening System

The detergent compositions of the invention may comprise softening agents for softening through the wash such as clay optionally also with flocculant and enzymes.

Further more specific description of suitable detergent components can be found in WO97/11151.

EXAMPLES

Example 1

Spray Drying Process

The following detergent slurries were made by mixing the ingredients into water in the order listed to achieve solid contents in finished product as shown in the middle column. Then the slurry was sprayed into a tower where heated air (250-280° C.) is blown into at air flow rate 8000-9000 kg/h. The air flow and temperature were achieved to the target moisture content to be 5% in finished product. Powders were cooled down through the air lift and sieved over size (>2000 mm) before being stored in a silo. These powders were mixed with dry additives and sprayed perfumes to be finished product as shown in the left end column.

| | Solids % in slurry | Solids % in finished product |
|---|---|---|
| Ingredients[1] | | |
| NaLAS | 17.0 | 17.0 |
| Dimethyle (Hydroxyethyl) Ammonium Chloride | 0.2 | 0.2 |
| Cleaning Polymer | 1.0 | 1.0 |
| Sodium silicate | 6.0 | 6.0 |
| Diethylene Triamine Penta Acetic Sodium Salt | 0.4 | 0.4 |
| Polyacrylic Acid | 1.0 | 1.0 |
| Carboxymethyl Cellulose | 0.2 | 0.2 |
| Brighteners | 0.2 | 0.2 |
| Phosphate | 16.0 | 16.0 |
| Sulfate | 33.0 | 33.0 |
| water | 12.0 | 5.0 |
| Misc. | | 0.4 |
| <Dry additives & perfumes> | | |
| Bleach | | 2.0 |
| Bleach activator | | 1.0 |
| Enzymes | | 0.5 |
| Sodium carbonate | | 15.0 |
| Perfumes | | 0.2 |
| Color speckles | | 0.9 |

[1]A detailed description of the ingredients in given below

Example 2

Agglomeration Process

The following ingredients were fed into a high speed mixer to achieve the solid contents in finished product as shown in middle column while liquid ingredients (acid form of LAS and Dimethyle Ammmonium Chloride solution and polymer) were injected. The mixer speed was 700-800 rpm. After that, further agglomeration happens in second high shear mixer at 50-70 rpm. Agglomerates from second mixer were sent to a fluid bed dryer at 120 C via sieving over size (>2000 um) to evaporate some excess moisture. Then agglomerates were cooled in another fluid bed at 15 C before being stored in a silo. These agglomerates were mixed with dry additives and perfume spray-on to be finished product as shown in the left end column of the table below.

| | Solids % in agglomeration | Solids % in finished product |
|---|---|---|
| Ingredients[1] | | |
| NaLAS | | 14.0 |
| Dimethyle (Hydroxyethyl) Ammonium Chloride | 0.2 | 0.2 |
| Cleaning Polymer | 0.5-1.0 | 0.5-1.0 |
| Sodium carbonate | 25.0 | 25.0 |
| Phosphate | 15.0 | 15.0 |
| Zeolite | 2.0 | 2.0 |
| Water (from raw materials) | 5.0 | 5.0 |
| Misc. | | 0.6 |
| <Dry additives & perfumes> | | |
| Diethylene Triamine Penta Acetic Sodium Salt | | 0.4 |
| Polyacrylic Acid | | 1.0 |

-continued

| | Solids % in agglomeration | Solids % in finished product |
|---|---|---|
| Carboxymethyl Cellulose | | 0.2 |
| Brighteners | | 0.2 |
| Sodium silicate | | 2.0 |
| Sulfate | | 27.0 |
| Bleach | | 2.0 |
| Bleach activator | | 1.0 |
| Enzymes | | 0.5 |
| Pefumes | | 0.2 |
| Color speckles | | 0.9 |

[1]A detailed description of the ingredients in given below

In following detergent compositions, enzymes levels are given as percent pure enzyme per 100 grams total composition. Unless stated otherwise, the balance of the compositions of the following examples are water and minors such as perfume, suds suppressors etc.

Example 3

Bleaching high duty laundry detergent compositions are prepared.

| Ingredients[1] | I | II | III | IV | V | VI | VII | VIII |
|---|---|---|---|---|---|---|---|---|
| Blown Powder | | | | | | | | |
| Zeolite A | 13.65 | 13.65 | — | — | — | — | — | — |
| Na Sulfate | 22.67 | 22.67 | 24.43 | 30.13 | — | — | — | — |
| LAS | 6.21 | 6.21 | 5.65 | — | — | — | — | — |
| QAS | — | — | — | 2.95 | — | — | — | — |
| MA/AA | 1.42 | 1.42 | 3.50 | 4.25 | — | — | — | — |
| EDDS | 0.19 | 0.19 | 0.19 | 0.23 | — | — | — | — |
| Brightener | 0.07 | 0.07 | 0.06 | 0.08 | — | — | — | — |
| Mg Sulfate | 0.65 | 0.65 | 0.39 | 0.48 | — | — | — | — |
| HEDMP | 0.17 | 0.17 | 0.17 | 0.21 | — | — | — | — |
| Cleaning Polymer | 1.0 | 1.0 | 1.0 | 1.0 | | | | |
| Agglomerate 1 | | | | | | | | |
| QAS | — | — | 0.9 | — | — | — | — | — |
| Carbonate | — | — | 2.45 | — | — | — | — | — |
| Na Sulfate | — | — | 2.45 | — | — | — | — | — |
| Agglomerate 2 | | | | | | | | |
| $C_{14-15}EO_7$ | — | — | 2.79 | 2.21 | — | — | — | — |
| Na Sulfate | — | — | 6.65 | 6.84 | — | — | — | — |
| Agglomerate 3 | | | | | | | | |
| LAS | — | — | — | — | 13.63 | 14.96 | — | 13.63 |
| Cleaning Polymer | — | — | — | — | 1.0 | 1.0 | 1.0 | 1.0 |
| Zeolite A | — | — | — | — | 21.42 | 23.51 | — | 21.42 |
| Agglomerate 4 | | | | | | | | |
| LAS | — | — | — | — | — | — | 8.12 | — |
| Na Sulfate | — | — | — | — | — | — | 23.54 | — |
| Na Carbonate | — | — | — | — | — | — | 8.12 | — |
| Dry additives | | | | | | | | |
| LAS | — | — | 6.40 | — | — | — | — | — |
| MA/AA (particle) | — | — | 0.89 | 0.89 | 0.95 | 0.95 | 0.99 | 0.95 |
| TAED | 3.58 | 3.58 | 3.80 | 2.70 | 5.89 | 5.89 | 6.14 | — |
| NOBS | — | — | — | — | — | — | — | 5.50 |
| LAS (flakes) | — | — | — | 27.0 | — | — | — | — |
| Silicate R 2.0 | 3.85 | 3.85 | 3.85 | 2.80 | — | — | — | — |
| Citric/Citrate | 3.58 | 3.58 | 3.58 | 3.58 | 3.80 | 3.80 | 3.96 | 3.80 |
| Na Carbonate | 7.72 | 7.72 | 13.84 | — | 12.35 | — | 12.87 | 12.35 |
| HEDP | — | — | — | — | 0.48 | 0.48 | 0.50 | 0.48 |
| PC3 or PB1 | 11.01 | 11.01 | 11.01 | 8.00 | 8.55 | 8.55 | 8.91 | 8.55 |

-continued

| Ingredients[1] | I | II | III | IV | V | VI | VII | VIII |
|---|---|---|---|---|---|---|---|---|
| Protease | 0.009 | 0.009 | 0.009 | 0.009 | 0.039 | 0.039 | 0.039 | 0.039 |
| Amylase | 0.005 | 0.005 | 0.005 | 0.005 | 0.013 | 0.013 | 0.013 | 0.013 |
| Lipase | — | — | — | — | 0.002 | 0.002 | 0.002 | 0.002 |
| Pectate lyase | — | — | — | — | 0.003 | 0.003 | 0.003 | 0.003 |
| Cellulase | 0.003 | — | 0.001 | — | 0.0005 | — | — | — |
| SS agglom. | 0.36 | 0.36 | 0.36 | 0.55 | 0.62 | 0.62 | 0.64 | 0.62 |
| Soap | 0.40 | 0.40 | 0.40 | 0.40 | 0.48 | 0.48 | 0.50 | 0.48 |
| Brightener | — | — | — | — | 0.10 | 0.10 | 0.10 | 0.10 |
| Na Sulfate | 4.48 | 4.48 | — | — | 14.30 | 22.85 | 14.90 | 14.30 |
| Spray-on | | | | | | | | |
| $C_{12-14}EO_7$ | 4.00 | 4.00 | — | — | 3.00 | 3.00 | 1.00 | 3.00 |
| Dusting | | | | | | | | |
| Zeolite A | — | — | — | — | 2.00 | 2.00 | — | 2.00 |
| Density (g/L) | 600 | 600 | 600 | 600 | 800 | 800 | 800 | 800 |

[1]A detailed description of the ingredients in given below

Example 4

The following laundry compositions, which can be in the form of granules or tablet, are prepared according to the present invention.

| Ingredients[1] | I | II | III | IV | V |
|---|---|---|---|---|---|
| Base Product | | | | | |
| $C_{14}$-$C_{15}$ AS/Tallow AS | 8.0 | 5.0 | 3.0 | 3.0 | 3.0 |
| LAS | 8.0 | — | 8.0 | — | 7.0 |
| $C_{12}C_{15}AE_3S$ | 0.5 | 2.0 | 1.0 | — | — |
| $C_{12}C_{15}AE_5/AE_3$ | 2.0 | — | 5.0 | 2.0 | 2.0 |
| QAS | — | — | — | 1.0 | 1.0 |
| Zeolite A | 20.0 | 18.0 | 11.0 | — | 10.0 |
| (Na-)SKS-6 (I) (dry add) | — | — | 9.0 | — | — |
| MA/AA | 2.0 | 2.0 | 2.0 | — | — |
| Cleaning Polymer | 1.0 | 1.0 | 1.0 | 1.0 | 0.1 |
| AA polymer | — | — | — | — | 4.0 |
| Citrate | — | 2.0 | — | — | — |
| Citric | 2.0 | — | 1.5 | 2.0 | — |

-continued

| Ingredients[1] | I | II | III | IV | V |
|---|---|---|---|---|---|
| DTPA | 0.2 | 0.2 | — | — | — |
| EDDS | — | — | 0.5 | 0.1 | — |
| HEDP | — | — | 0.2 | 0.1 | — |
| PB1 | 3.0 | 5.0 | 10.0 | — | 4.0 |
| Percarbonate | — | — | — | 18.0 | — |
| NOBS | 3.0 | 4.0 | — | — | 4.0 |
| TAED | — | — | 2.0 | 5.0 | — |
| Carbonate | 15.0 | 18.0 | 8.0 | 15.0 | 15.0 |
| Sulphate | 5.0 | 12.0 | 2.0 | 17.0 | 3.0 |
| Silicate | — | 1.0 | — | — | 8.0 |
| Protease | 0.033 | 0.033 | 0.033 | 0.046 | 0.033 |
| Lipase | 0.008 | 0.008 | 0.008 | 0.008 | 0.006 |
| Amylase | 0.001 | 0.001 | 0.001 | 0.0014 | 0.001 |
| Cellulase | 0.0014 | 0.0014 | 0.0014 | 0.01 | — |

[1]A detailed description of the ingredients in given below

Example 5

The Following Granular Detergents are Prepared

| Ingredients[1] | I | II | III | IV | V | VI | VII |
|---|---|---|---|---|---|---|---|
| LAS | 7.23 | 8.46 | 6.50 | 7.09 | 11.13 | 16.0 | 16.0 |
| QAS | 0.75 | — | 0.60 | 0.60 | 1.00 | — | — |
| $C_{14-15}EO_7$ | 3.50 | 5.17 | 3.50 | 3.70 | 3.50 | — | — |
| $C_{12-14}AE_3S$ | 0.25 | — | — | — | — | 0.70 | 1.0 |
| $C_{12-14}$—$N^+(CH_3)_2(C_2H_4OH)$ | — | — | — | — | — | 0.50 | 0.50 |
| Na tripolyphosphate | 18.62 | 25.00 | 18.62 | 24.00 | 45.00 | 15.0 | 18.0 |
| Zeolite A | — | — | 0.79 | — | — | 0.18 | 0.3 |
| Citric acid | 1.29 | — | 1.29 | — | — | — | — |
| Sodium Silicate | 3.10 | 8.00 | 4.26 | 3.87 | 10.00 | 8.0 | 6.0 |
| Sodium Carbonate | 18.04 | 11.00 | 18.04 | 18.98 | 0.42 | 14..5 | 16.0 |
| Sulfate | 17.58 | 3.98 | 19.93 | 15.48 | 10.13 | 30.0 | 30.0 |
| CMC | — | — | — | — | — | 0.20 | 0.20 |
| AA/MA | 2.15 | 1.50 | 1.85 | 1.60 | 1.94 | 0.1 | 0.05 |
| AA polymer | — | — | — | — | — | — | 1.20 |
| Cleaning Polymer | 1.0 | 1.0 | 1.0 | 1.0 | 1.0 | 1.0 | 0.5 |
| Amine ethoxylate polymer | 0.60 | — | 0.49 | — | — | — | 1.25 |
| Cyclic polyamine polymer | 0.07 | — | 0.07 | — | — | — | — |
| Percarbonate | 13.15 | — | 10.77 | — | — | — | — |
| PB1/PB4 | — | 9.0/9.0 | — | 10.45/0 | 2.37/0 | — | — |
| TAED | 2.50 | 5.00 | 1.58 | 1.52 | 0.66 | — | — |
| DTPA | 0.34 | 0.34 | 0.37 | 0.39 | 0.24 | 0.30 | 0.30 |
| Mg Sulfate | 1.37 | 1.43 | 1.37 | 1.41 | 0.58 | — | — |
| Protease | 0.005 | 0.011 | 0.006 | — | — | 0.006 | 0.003 |

-continued

| Ingredients[1] | I | II | III | IV | V | VI | VII |
|---|---|---|---|---|---|---|---|
| Amylase | 0.001 | 0.003 | 0.001 | 0.001 | — | — | 0.001 |
| Cellulase | 0.0003 | 0.0002 | 0.0003 | 0.0003 | — | — | — |
| Brightener | 0.10 | 0.17 | 0.08 | 0.08 | 0.08 | 0.23 | 0.15 |

[1]A detailed description of the ingredients in given below

Example 6

The following granular fabric detergent compositions which provide "softening through the wash" are prepared:

| Ingredients[1] | I | II | III | IV |
|---|---|---|---|---|
| $C_{12-15}AS$ | 0.3 | 3.43 | 2.52 | 1.05 |
| LAS | 11.0 | 5.3 | 6.55 | 7.81 |
| $C_{12-14}AE_3S$ | — | 0.74 | 0.33 | — |
| LAS (mid branched) | — | — | 1.71 | 1.37 |
| $C_{14-15}EO_7$ | — | 2.00 | 2.00 | 2.00 |
| QAS | — | 1.57 | 1.20 | 1.35 |
| Cleaning Polymer | 1.0 | 1.0 | 1.0 | 1.0 |
| Citric acid | 2.5 | 1.28 | 1.28 | 1.28 |
| (Na-)SKS-6 | 4.0 | 4.71 | 4.96 | 4.71 |
| Zeolite A | 12.0 | 13.51 | 11.31 | 15.6 |
| Percarbonate | 6.5 | 9.03 | 9.03 | 10.3 |
| TAED | 1.5 | 2.48 | 2.48 | 3.22 |
| EDDS | 0.1 | 0.1 | 0.1 | 0.1 |
| HEDP | 1.2 | 0.20 | 0.20 | 0.20 |
| Smectite clay | 10.0 | — | 13.84 | — |
| Polyethylene oxide (MW approx. 300,000) | 0.2 | 0.22 | 0.22 | — |
| Protease | 0.011 | 0.009 | 0.009 | 0.009 |
| Amylase | 0.002 | 0.001 | 0.001 | 0.001 |
| Cellulase | — | 0.0006 | 0.0006 | 0.0006 |
| Na Carbonate | 25.0 | 29.68 | 30.52 | 28.30 |
| Magnesium Sulfate | 0.1 | 0.03 | 0.03 | 0.03 |
| Suds suppressor | 1.0 | 1.0 | 1.0 | 1.0 |
| EMC | — | 1.10 | 1.10 | 1.10 |
| HEC | 0.8 | — | — | — |
| Sodium sulfate | 18.0 | balance | balance | balance |

[1]A detailed description of the ingredients in given below

Abbreviated component identifications for the preceding examples are as follows:

| | |
|---|---|
| LAS | Sodium linear $C_{11-13}$ alkyl benzene sulphonate |
| CxyAS | Sodium $C_{1c}$—$C_{1y}$ alkyl sulfate. |
| CxyEzS | $C_{1x}$—$C_{1y}$ sodium alkyl sulfate condensed with an average of z moles of ethylene oxide. |
| CxEOy | Cx alcohol with an average of ethoxylation of y |
| QAS | $R_2.N + (CH_3)_2(C_2H_4OH)$ with $R_2 = C_{10}$-$C_{12}$ |
| Soap | Sodium linear alkyl carboxylate derived from a 80/20 mixture of tallow and coconut fatty acids. |
| Silicate | Amorphous Sodium Silicate ($SiO_2$:$Na_2O$ ratio = 1.6-3.2:1). |
| Zeolite A | Hydrated Sodium Aluminosilicate of formula $Na_{12}(AlO_2SiO_2)_{12}.27H_2O$ having a primary particle size in the range from 0.1 to 10 micrometers (Weight expressed on an anhydrous basis). |
| (Na-)SKS-6 | Crystalline layered silicate of formula δ-$Na_2Si_2O_5$. |
| Citrate | Tri-sodium citrate dihydrate. |
| Citric | Anhydrous citric acid. |
| Carbonate | Anhydrous sodium carbonate. |
| Sulphate | Anhydrous sodium sulphate. |
| MA/AA | Random copolymer of 4:1 acrylate/maleate, average molecular weight about 70,000-80,000. |
| AA polymer | Sodium polyacrylate polymer of average molecular weight 4,500. |

-continued

| | |
|---|---|
| Cleaning Polymer | Copolymer of PEG 6000 and vinyl acetate in weight ratio 40:60 prepared at 70 degrees Celsius using radical initiator catalyst (0% hydrolysed) |
| PB1/PB4 | Anhydrous sodium perborate monohydrate/tetrahydrate. |
| PC3 | Anhydrous sodium percarbonate [$2.74Na_2CO_3.3H_2O_2$] |
| TAED | Tetraacetyl ethylene diamine. |
| NOBS | Nonanoyloxybenzene sulfonate in the form of the sodium salt. |
| DTPA | Diethylene triamine pentaacetic acid. |
| HEDP | Hydroxyethane di phosphonate |
| HEDMP | Hydroxyethane di (methylene) phosphonate |
| DETPMP | Diethyltriamine penta (methylene) phosphonate |
| EDDS | Na salt of Ethylenediamine-N,N'-disuccinic acid, (S,S) isomer |
| Protease | Proteolytic enzyme sold under the tradename Savinase ®, Alcalase ®, Everlase ®, by Novozymes A/S, Properase ®, Purafect ®, Purafect MA ® and Purafect Ox ® sold by Genencor and proteases described in patents WO 91/06637 and/or WO 95/10591 and/or EP 0 251 446. |
| Amylase | Amylolytic enzyme sold under the tradename Purastar ®, Purafect Oxam ® sold by Genencor; Termamyl ®, Fungamyl ® Duramyl ®, Stainzyme ® and Natalase ® sold by Novozymes A/S. |
| Lipase | Lipolytic enzyme sold under the tradename Lipolase ® Lipolase Ultra ® by Novozymes A/S. |
| Cellulase | Cellulytic enzyme sold under the tradename Carezyme ®, Celluzyme ® and/or Endolase ® by Novozymes A/S or a Glucanase enzyme |
| Pectate Lyase | Pectawash ®, Pectaway ® sold by Novozymes |
| Mannanase | Mannaway ® sold by Novozymes |
| CMC or HEC or EMC | Carboxymethyl or Hydroxyethyl or ester modified cellulose. |
| SS Agglom. | 12% Silicone/silica, 18% stearyl alcohol,70% starch in granular form [suds suppressor agglomerate]. |
| TEPAE | Tetreaethylenepentaamine ethoxylate. |
| Photobleach | Sulfonated zinc phtalocyanine |
| pH | Measured as a 1% solution in distilled water at 20° C. |

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A detergent auxiliary composition comprising (a) from 0.001 wt % to 99 wt % cleaning polymer said cleaning polymer having (i) a hydrophilic backbone and (ii) at least one hydrophobic pendant group, and (b) an adjunct ingredient, wherein said hydrophilic backbone constitutes less than 50%, by weight of the cleaning polymer, wherein said cleaning polymer comprises a random graft polymer obtained from grafting a) a polyethylene oxide; b) a vinyl ester derived from acetic acid and/or propionic acid, an alkyl ester of acrylic or methacylic acid in which the alkyl group contains from 1 to 4 carbon atoms, and mixtures thereof; and c) a modifying monomer selected from the group consisting of styrene, maleic acid, acrylamide, vinyl acetic acid, vinyl formamide, and mixtures thereof.

2. A detergent auxiliary composition according to claim 1 wherein said hydrophilic backbone constitutes less than 45% by weight of the cleaning polymer.

3. A detergent auxiliary composition according to claim 1 in the form of a particle.

4. A detergent auxiliary composition according to claim 3 in the form of a spray dried particle.

5. A detergent auxiliary composition according to claim 3 in the form of an agglomerate or an extruded particle.

6. A detergent auxiliary composition according to claim 1 wherein the cleaning polymer is present in an amount of from 0.1 to 15 wt % based on total weight of the detergent auxiliary composition.

7. A detergent auxiliary composition according to claim 1 wherein the backbone of said cleaning polymer comprises monomers selected from the group consisting of unsaturated C1-6 acids, ethers, alcohols, aldehydes, ketones or esters, sugar units, alkoxy units, maleic anhydride and/or saturated polyalcohols and mixtures thereof.

8. A detergent auxiliary composition according to claim 1 wherein the backbone of said cleaning polymer comprises monomers selected from the group comprising acrylic acid, methacrylic acid, maleic acid, vinyl acetic acid, glucosides, ethylene oxide and/or glycerol, and mixtures thereof.

9. A detergent auxiliary composition according to claim 1 wherein said at least one hydrophobic pendant groups comprise groups independently selected from C5-25 alkyl groups, polypropylene and polybutylene units, vinyl esters of saturated monocarboxylic acid containing from 1 to 6 carbon atoms, C1-6 alkyl ester of acrylic or methacylic acid, N-vinylpyrrolidone, styrene; and mixtures thereof.

10. A detergent composition comprising from 0.1 wt % to 90 wt % of the detergent auxiliary composition according to claim 1.

11. A process for making a detergent auxiliary composition according to claim 1 wherein a first step a slurry is prepared comprising mixing the cleaning polymer and a detergent adjunct ingredient, in a second step, the slurry is then sprayed through a spray-drying tower and dried to a moisture content of from 1 to 10 wt % (based on free and bound water).

12. A detergent auxiliary composition according to claim 1, wherein said modifying monomer comprises styrene.

13. A detergent auxiliary composition according to claim 1, wherein said cleaning polymer has the formula:

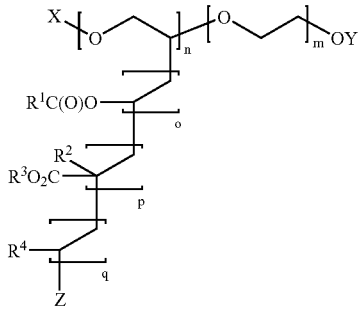

wherein X and Y are independently selected from a hydrogen, a C1-C6 alkyl, and combinations thereof;

wherein Z is independently selected from hydrogen, C-radical moiety, and combinations thereof;

wherein each $R^1$ is independently selected from a methyl, an ethyl, and combinations thereof;

wherein each $R^2$ is independently selected from a hydrogen, a methyl, and combinations thereof;

wherein each $R^3$ is independently selected from a C1-C4 alkyl;

wherein each $R^4$ is independently selected from a pyrrolidone, a phenyl group, and combinations thereof; and wherein the value of m, n, o, p and q is selected such that the molecular weight of the polyethylene oxide backbone is from about 1000 to 12000 g/mol.

14. A detergent auxiliary composition according to claim 13, wherein the pendant groups comprise at least 50 weight %, up to 98 weight % of the polymer.

15. A detergent auxiliary composition according to claim 13, wherein the cleaning polymer has a molecular weight from 1000 g/mol to 150000 g/mol.

16. A detergent auxiliary composition according to claim 13, wherein the cleaning polymer further comprises from about 0.5 to about 1.5 graft points per backbone monomer unit.

17. The detergent auxiliary composition according to claim 12, wherein said modifying monomer comprises styrene at a level of from about 0.1% to about 5% by weight of said hydrophobic side chain.

18. The detergent auxiliary composition according to claim 1, wherein said modifying monomer further comprises N-vinylpyrrolidone, acrylic acid, methacrylic acid, and mixtures thereof.

19. The detergent auxiliary composition according to claim 18, wherein said modifying monomer comprises N-vinylpyrrolidone at a level of from about 0.1% to about 10% by weight of said hydrophobic side chain.

20. The detergent auxiliary composition according to claim 17, wherein said modifying monomer further comprises N-vinylpyrrolidone at a level of from about 0.1% to about 10% by weight of said hydrophobic side chain.

21. The detergent auxiliary composition according to claim 7 wherein said saturated polyalcohol is glycerol.

* * * * *

UNITED STATES PATENT AND TRADEMARK OFFICE

CERTIFICATE OF CORRECTION

PATENT NO. : 7,465,701 B2
APPLICATION NO. : 11/443706
DATED : December 16, 2008
INVENTOR(S) : Sanjeev Sharma et al.

It is certified that error appears in the above-identified patent and that said Letters Patent is hereby corrected as shown below:

Column 4
Line 8, after the words "7500 or", delete "1000" and insert -- 10000 --.

Column 11
Line 47, delete "3,7628,59" and insert -- 3,762,859 --.

Signed and Sealed this

Eleventh Day of August, 2009

David J. Kappos

David J. Kappos
*Director of the United States Patent and Trademark Office*